United States Patent [19]

Piso

[11] 4,149,816

[45] Apr. 17, 1979

[54] METAL SHAFT COVER FRAME

[76] Inventor: Johannes L. Piso, Ghürschweg 17, CH-6020 Emmenbrucke, Switzerland

[21] Appl. No.: 875,235

[22] Filed: Feb. 6, 1978

[51] Int. Cl.[2] ..... E02D 29/14

[52] U.S. Cl. ..... 404/26

[58] Field of Search ..... 404/25, 26; 52/21, 19; 49/35

[56] References Cited

U.S. PATENT DOCUMENTS

| | | | |
|---|---|---|---|
| 1,751,194 | 3/1930 | Elsy | 404/26 |
| 2,431,082 | 11/1947 | Sayles | 404/26 |
| 2,593,918 | 4/1952 | Redman | 404/26 |
| 3,237,538 | 3/1966 | McPheeters | 404/26 |
| 3,263,579 | 8/1966 | Dorris | 404/26 |
| 3,408,778 | 11/1968 | Mason | 404/26 X |
| 3,773,428 | 11/1973 | Bowman | 404/26 |

*Primary Examiner*—Nile C. Byers, Jr.

*Attorney, Agent, or Firm*—Thomas W. Speckman

[57] ABSTRACT

The invention provides a metal cover frame for an open shaft, adapted to be installed flush with a road surface and connected in a vertically adjustable manner to a concrete frame which is adapted to rest on the upper end of the shaft, the metal frame comprising through holes provided in an inwardly projecting lip of the metal frame, and collects corresponding to the through holes in the metal frame being provided in the concrete frame, the collets being adapted to receive tightening screws penetrating the through holes.

2 Claims, 4 Drawing Figures

METAL SHAFT COVER FRAME

The invention relates to a shaft cover frame of metal adapted to be installed flush with the roadway in a road surface. Shaft coverings usually comprise a cast top or cast grate and a shaft frame or cast frame. For heavy and fast traffic the cast frame is fixed in a concrete frame. The concrete frame rests on the subjacent shaft construction of poured-in-place concrete or of prefabricated elements.

The fixing of the cast frame to the concrete frame is carried out by grouting it into a frame poured at the site or by mortaring it on a prefabricated frame. Sometimes the cast frame is cast directly into the prefabricated frame.

For the purpose of fixing the cast frames, depending on their make and type, they are provided on the outside with ribs or hollow spaces or with both. The footplate of the cast frame is frequently broadened outwardly beyond the crosspiece. This results in anchoring in or on the concrete frame in the best manner possible.

Since the cast frame is grouted into the concrete frame or fixed thereon with cement mortar, the entire cast-concrete-frame construction must be raised and must possibly be inclined slightly when adapting it to a new road level.

These adaptions are required in any case if the top covering layer is installed substantially later than the subjacent covering layers and also when the roadway is resurfaced.

After applying the new covering layer, the cover surface, which lies above the concrete frame and is substantially larger than the surface of the cast top or cast grate, must be cut out again, the concrete frame including the cast frame must be raised to the new road level and grouted with cement mortar. The cut-out cover surface is then filled in again with asphalt concrete and compacted with hand rams, and, if required, rolled with small rollers.

This procedure has the following disadvantages:

high costs due to great expenditure of time, use of tools and possibly machines;

cumbersome vertical adjustment;

the cover surface above the concrete frame has an absolutely unacceptable content of hollow spaces due to insufficient compacting;

additional working seams are formed in the cover surface; and the traffic must be stopped or restricted for a lengthy period.

Recently it has also been possible to attain the vertical adjustment by inserting a spacer in the cast frame and bolting it thereto. The cover rests on this spacer. The vertical adjustment must exceed a certain minimum and can be carried out only stepwise corresponding to the thicknesses of the spacer. Moreover, the new plane of the shaft top must necessarily be parallel with the original plane.

It is the aim of this invention to provide a shaft frame which enables a simple, accurate-to-the-millimeter adaptation of the top to the roadway surface with arbitrary inclination but without additionally breaking up the road.

According to the present invention there is provided a metal cover frame for a shaft, adapted to be installed flush with a road surface and connected in a vertically adjustable manner to a concrete frame which is adapted to rest on the upper end of the shaft wall, the metal frame comprising through holes provided in an inwardly projecting lip of the metal frame, and screw collets corresponding to the through holes in the metal frame being provided in the concrete frame, the collets being adapted to receive tightening screws penetrating the through holes.

The invention will now be described in more detail, by way of example only, with reference to the accompanying drawings, in which.

Figure 2:
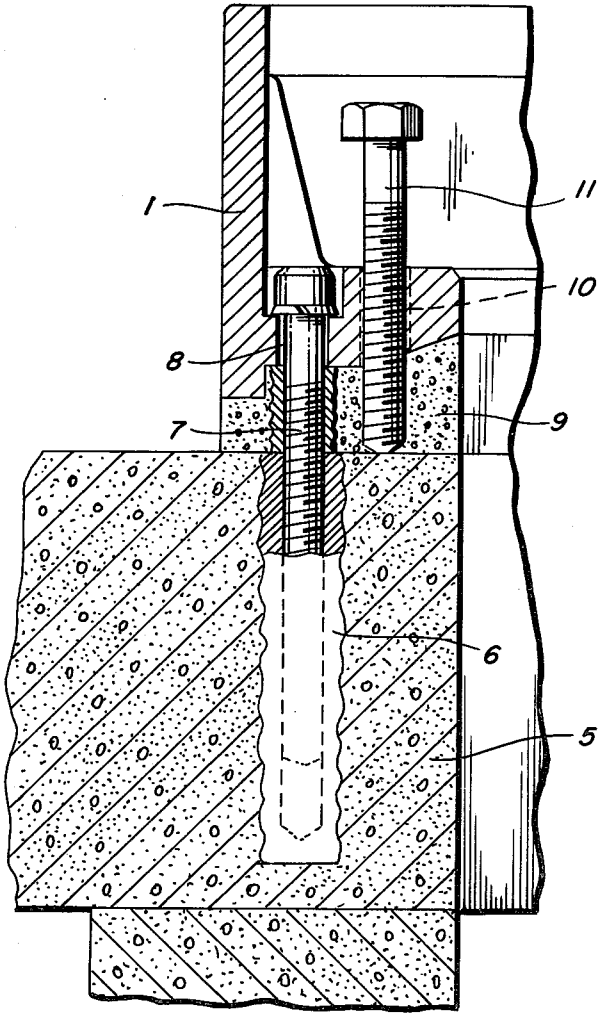
FIG. 2 shows a partial section through a shaft frame in the region of a through hole and of a set screw as a vertical adjustment means.
Figure 1:
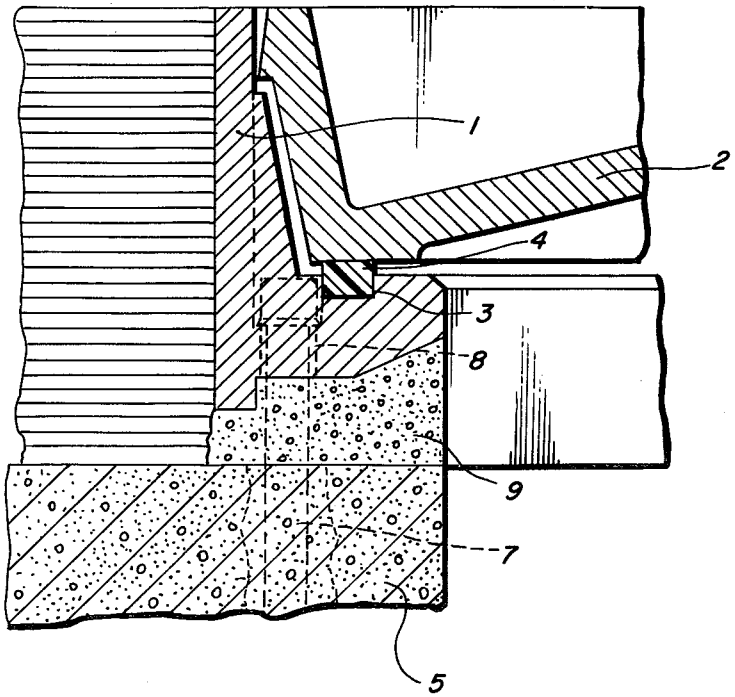
FIG. 1 shows a partial section through a shaft frame.

In the drawings the shaft frame is labelled 1. This kind of frame is usually cast from metal. A likewise cast top 2 or grate fits in this cast frame. The two parts, the frame and the top or grate form together the covering for the shaft or manhole. Recent frame constructions have a groove 3 into which a plastic ring 4 can be inserted. This kind of plastic ring is commercially available of neoprene.

The concrete frame 5 to which the shaft frame 1 of metal is to be so connected that it is vertically adjustable has collets 6. In the case of prefabricated concrete frames 5 such collets could be provided in such a way that they are cast directly into said frame or they can be secured subsequently. If the concrete frames are poured in place, then the collets can also be attached subsequently or grouted at the predetermined places with an auxiliary device. Regardless of the manner of installation, it is important that the positions of the collets correspond to the through holes 8. Through holes 8 may be slotted holes.

If the cast frame 1 is secured to the concrete frame 5 by means of screws 7 but the screws are not yet tightened, then the metal frame is positioned but it is not yet vertically adjusted.

The vertical adjustment by which the shaft frame 1 is so adjusted that it is flush with the roadway surface can be carried out in various ways. In the simplest case the vertical adjustment can be achieved by means of wedge fillets.

Figure 3:
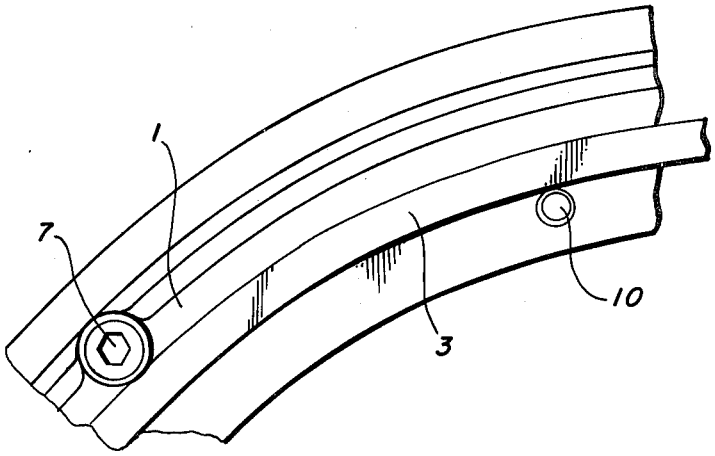
FIG. 3 shows a partial plan view of a shaft frame according to FIGS. 1 and 2.

The FIGS. 2 and 3 show, as the means of vertical adjustment, threaded holes 10 into which the setscrews 11 fit. At least three setscrews are required for the exact adjustment. It is possible that particularly heavy constructions require a larger number of setscrews. However, such setscrews can only have a supporting function but no levelling function.

Figure 4:
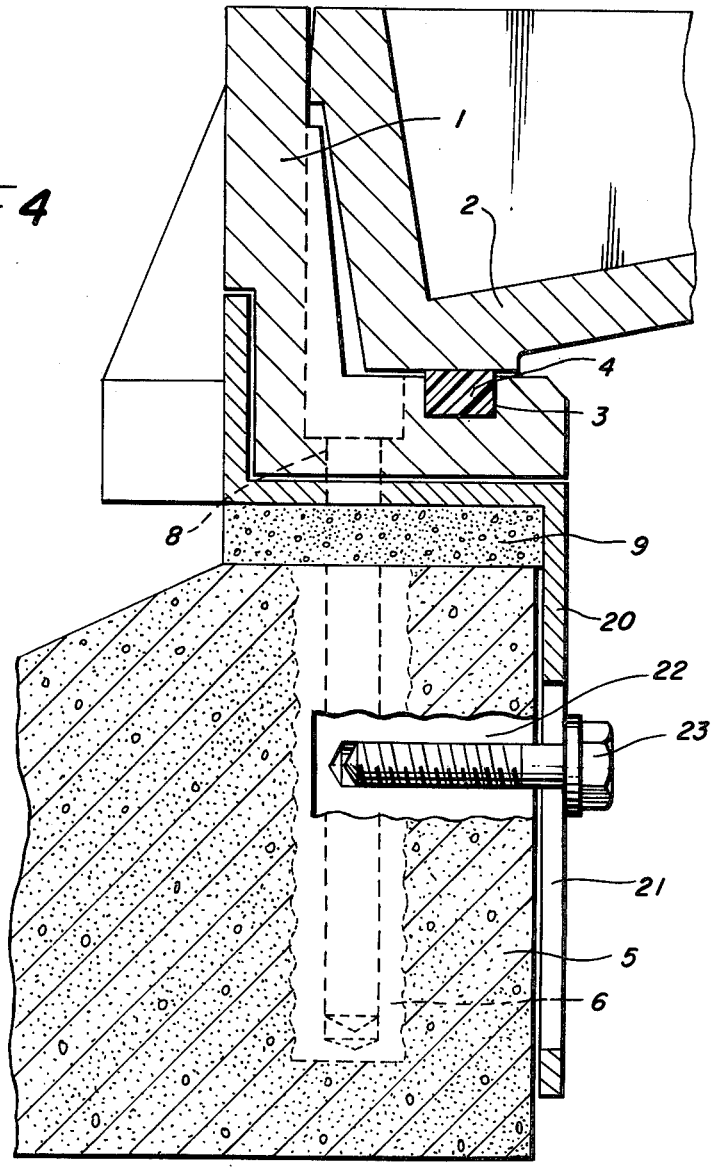
FIG. 4 shows a partial section through a shaft frame in the region of a Z-shaped angle iron as a vertical adjustment means.

A further modification of the vertical adjustment is shown in FIG. 4. In this embodiment the shaft frame 1 rests on at least three Z-profiled supports 20 of metal. The extended leg of the Z-profile has a slotted hole 21. The support is secured to the concrete frame 5 at the desired level by means of collets 22 and, screws 23.

However, the vertical adjustment can also be attained by combining the screws 7, for example, with check nuts screwed thereto or with collars screwed thereto, the metal shaft frame resting on said check nuts or collars.

The metal shaft cover frame according to the invention is installed, for example, by first positioning the shaft frame 1 by means of the screws 7. The concrete frame 5 has already been raised to the final level. The final fine coating is then applied over the shaft cover and compacted with rollers. The bituminous coating on top of the shaft cover is then removed, whereupon the top or grate is removed. The fixing screws 7 and the threaded holes 10 are now freely accessible. On loosening the screws 7 sufficiently the vertical adjustment can be carried out with the setscrews 11. It is advantageous to screw the shaft frame slightly too high, to tamp it with cement mortar 9, to remove the setscrews 11 and then to pull the frame down to the correct level by means of the screws 7 and to compact the cement mortar at the same time.

Of course this mode of installation can be varied. The installation naturally differs depending on the means of vertical adjustment. However, because of the shaft frame according to the invention all the manners of installation have the following substantial advantages:

no additional breaking-up of roads;

minimum of time required for the adaptation to the level; and good compaction of the road surface even at the edge of the shaft frame of metal.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A metal cover frame for an open shaft, adapted to be installed flush with a road surface and connected in a vertically adjustable manner, to adapt to new road levels when the roadway is resurfaced, to a concrete frame which is adapted to rest on the upper end of the shaft, the metal frame comprising means for holding a cover and having an inwardly projecting lip provided with through holes, collets adapted to receive tightening screws corresponding to the through holes in the metal frame being provided in the concrete frame, and tightening screws penetrating the through holes and received in the collets to secure the metal cover frame to said concrete frame, said inwardly projecting lip provided with integral raising means comprising said tightening screws at the bottom side of the inwardly projecting lip of the cover frame being provided with collars so that the vertical adjustment can be carried out by means of the tightening screws for raising said cover frame in respect to said concrete frame, said raising means being accessible upon lifting said cover.

2. A metal frame according to claim 1, wherein the through holes are slotted holes.

* * * * *